US008443486B2

(12) United States Patent
Yamaura et al.

(10) Patent No.: US 8,443,486 B2
(45) Date of Patent: May 21, 2013

(54) ELECTRIC VACUUM CLEANER

(75) Inventors: Izumi Yamaura, Hyogo (JP); Koichi Nakano, Osaka (JP); Tetsuya Kouda, Osaka (JP); Katsuyuki Oota, Shiga (JP)

(73) Assignee: Panasonic Corporation, Osaka (JP)

( * ) Notice: Subject to any disclaimer, the term of this patent is extended or adjusted under 35 U.S.C. 154(b) by 365 days.

(21) Appl. No.: 12/743,267

(22) PCT Filed: Jul. 17, 2008

(86) PCT No.: PCT/JP2008/001919
§ 371 (c)(1),
(2), (4) Date: May 17, 2010

(87) PCT Pub. No.: WO2009/063581
PCT Pub. Date: May 22, 2009

(65) Prior Publication Data

US 2010/0275406 A1 Nov. 4, 2010

(30) Foreign Application Priority Data

Nov. 16, 2007 (JP) ..... 2007-297718

(51) Int. Cl.
*B01D 50/00* (2006.01)

(52) U.S. Cl.
USPC ..... 15/347; 15/353; 55/337; 55/525; 55/DIG. 3

(58) Field of Classification Search
USPC ..... 15/327.7, 347, 353; 55/DIG. 3, 337, 55/525
See application file for complete search history.

(56) References Cited

U.S. PATENT DOCUMENTS 5,273,561 A * 12/1993 Zeren ..... 96/406
6,488,744 B2 * 12/2002 Cartellone ..... 95/268

(Continued)

FOREIGN PATENT DOCUMENTS

EP 0972573 A1 1/2000
JP 52-55061 4/1977

(Continued)

OTHER PUBLICATIONS

Chinese Office Action for Application No. 200880116081.4, dated Feb. 29, 2012.

(Continued)

*Primary Examiner* — William Gilbert
*Assistant Examiner* — Alp Akbasli
(74) *Attorney, Agent, or Firm* — RatnerPrestia

(57) ABSTRACT

A vacuum cleaner includes an electric air blower; a dust separator placed at an upstream side of the electric air blower and having a filtration filter for taking in dust-containing air sucked by the electric air blower and separating the dust from the air; and a dust accommodating section for accommodating the dust separated by the dust separator. The filtration filter includes a plurality of through-holes penetrating from an upstream surface at an upstream side to a downstream surface at the downstream side, and a central axis of the through-hole is inclined with respect to a normal line direction of a surface of the filtration filter.

7 Claims, 15 Drawing Sheets

U.S. PATENT DOCUMENTS

| | | | | |
|---|---|---|---|---|
| 6,547,856 | B2 * | 4/2003 | Cartellone | 95/268 |
| 7,247,181 | B2 * | 7/2007 | Hansen et al. | 55/337 |
| 7,326,267 | B2 * | 2/2008 | David | 55/337 |
| 7,588,610 | B2 * | 9/2009 | Yoshida et al. | 55/309 |
| 7,628,831 | B2 * | 12/2009 | Gomiciaga-Pereda et al. | 55/337 |
| 7,635,400 | B2 * | 12/2009 | Yoo | 55/345 |
| 7,879,120 | B2 * | 2/2011 | Seo et al. | 55/345 |
| 8,062,398 | B2 * | 11/2011 | Luo et al. | 55/337 |
| 8,141,200 | B2 * | 3/2012 | Barker et al. | 15/347 |
| 2002/0011054 | A1 | 1/2002 | Yung | |
| 2003/0159239 | A1 | 8/2003 | Oh | |
| 2006/0162298 | A1 * | 7/2006 | Oh et al. | 55/337 |
| 2006/0218744 | A1 * | 10/2006 | Hayashi et al. | 15/347 |
| 2007/0095028 | A1 * | 5/2007 | Kim et al. | 55/337 |
| 2007/0119129 | A1 * | 5/2007 | Jeon | 55/337 |
| 2009/0007369 | A1 * | 1/2009 | Gomiciaga-Pereda et al. | 15/347 |
| 2009/0007370 | A1 * | 1/2009 | Gomiciaga-Pereda et al. | 15/353 |
| 2009/0044369 | A1 * | 2/2009 | Heumann et al. | 15/302 |
| 2009/0056060 | A1 * | 3/2009 | Han et al. | 15/349 |
| 2009/0313783 | A1 | 12/2009 | Nakano et al. | |
| 2009/0314312 | A1 * | 12/2009 | Fuchigami et al. | 134/9 |

FOREIGN PATENT DOCUMENTS

| | | | |
|---|---|---|---|
| JP | 52-60178 | | 5/1977 |
| JP | 52-074175 | | 6/1977 |
| JP | 53-50164 | | 4/1978 |
| JP | 2001-275898 | A | 10/2001 |
| JP | 2001-275898 | A | 10/2001 |
| JP | 2005-7211 | A | 1/2005 |
| JP | 2005-52394 | A | 3/2005 |
| JP | 2007-125416 | A | 5/2007 |
| JP | 2007-1125416 | A | 5/2007 |
| WO | WO 2007/114275 | A1 | 10/2007 |
| WO | WO 2007/114275 | A1 | 10/2007 |

OTHER PUBLICATIONS

International Search Report for PCT/JP2008/001919, Aug. 12, 2008.

Supplementary European Search Report for PCT/JP2008001919 dated Nov. 13, 2012.

* cited by examiner

ELECTRIC VACUUM CLEANER

This application is a U.S. National Phase Application of PCT International Application PCT/JP2008/001919.

TECHNICAL FIELD

The present invention relates to a vacuum cleaner having a filtration filter for separating dust.

BACKGROUND ART

In recent years, much attention has been paid to cyclone vacuum cleaners, that is, vacuum cleaners allowing airflow of sucked air to have a whirling component and separating and removing dust from the airflow with a centrifugal force. Vacuum cleaners of this type employ a configuration for generating a whirling air current in a dust collecting case, separating dust from the sucked airflow with a centrifugal force of the whirling air current, and accumulating the separated dust in the dust collecting case.

Recently, a filtration filter formed of a metal plate having small through-holes has been proposed in which the removal of dust attached to the filtration filter is simplified (see, for example, Patent Document 1).

As described in Patent Document 1, when a filtration filter is made of a metal plate having small through-holes, dust attached to the filtration filter can be removed in more simple and easy manner as compared with a filtration filter made of a non-woven fabric.

However, thread-like dust (hair, pet hair, and long thin fiber lint, and the like) sucked during cleaning is guided to through-holes of filtration filter together with sucked airflow and stuck in the through-holes. Then, other dust is attached to the thread-like dust stuck in the through-holes and cotton lint grows large around the stuck thread-like dust as a core. Consequently, when collected dust is discharged, cotton lint, hair and the like hung from the through-holes of the filtration filter, thus making it difficult to discharge the collected dust.

Note here that the thread-like dust used in this description is intended to mean dust having a thin long shape. An example of the thread-like dust includes hair, pet hair, and furthermore thin fiber lint.

Patent document 1; Japanese Patent Unexamined Publication No. 2005-52394

SUMMARY OF THE INVENTION

A vacuum cleaner of the present invention has a configuration including an electric air blower; a dust separator placed at an upstream side of the electric air blower and having a filtration filter for taking in dust-containing air sucked by the electric air blower and separating the dust from the air; and a dust accommodating section for accommodating the dust separated by the dust separator. The filtration filter includes a plurality of through-holes penetrating from an upstream surface at an upstream side to a downstream surface at the downstream side, and a central axis of the through-hole is inclined with respect to a normal line direction of a surface of the filtration filter.

With such a configuration, since the through-hole having an inclined angle with respect to a normal line direction of the filtration filter prevents thread-like dust from entering therein, it is possible to inhibit thread-like dust from being stuck and tangled in the through-hole or clogging therein. Therefore, when dust is discharged after cleaning work, dust including thread-like dust is not tangled in the through-hole of the filtration filter. Thus, discharging operation of dust can be facilitated.

REFERENCE MARKS IN THE DRAWINGS

Figure 1:
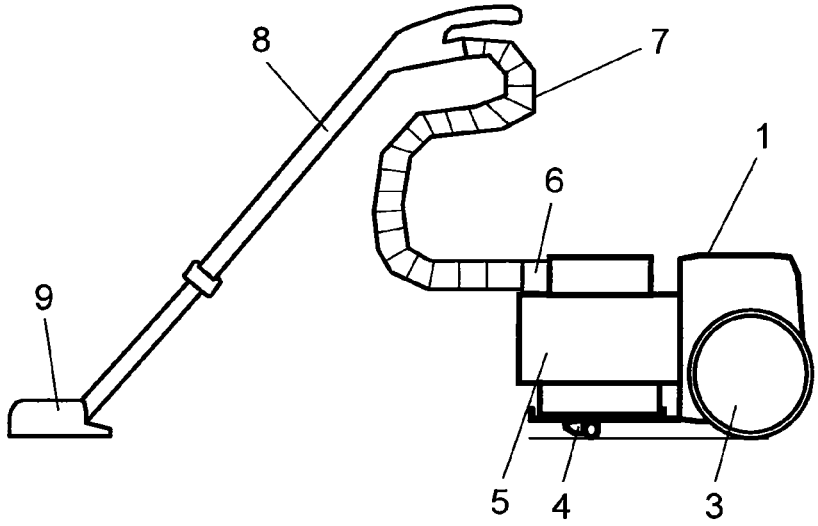
FIG. 1 shows an entire configuration of a vacuum cleaner in accordance with a first exemplary embodiment of the present invention.

1 cleaner main body
5 dust collecting case
6 suction port
21 electric air blower
23 dust separator
24 dust accommodating section
27 cylindrical filtration filter
27*a*, 227*a* first filtration filter (filtration filter)
27*b* second filtration filter
28, 38, 48, 58 through-hole
29*a* first air passage (main air passage)
29*b* second air passage (secondary air passage)
31 cover
33 space
41 pleated filter
42 dent
50 whirling air current
52*c* thread-like dust
71 sucked airflow
101 metal plate
104, 204, 304 first etched hole
105, 205, 305 second etched hole

DETAILED DESCRIPTION OF THE PREFERRED EMBODIMENT

Hereinafter, exemplary embodiments of the present invention are described with reference to drawings. Note here that the present invention is not limited to the exemplary embodiments.

First Exemplary Embodiment

FIG. 1 shows an entire configuration of a vacuum cleaner in accordance with a first exemplary embodiment of the present invention. Cleaner main body 1 is coupled to suction port 6, suction hose 7, and extension tube 8 sequentially. Suction tool 9 is mounted to the tip of extension tube 8. By operating electric air blower 21, electric air blower 21 generates suction air, so that dust on the floor in a house can be sucked from suction tool 9 into cleaner main body 1. Electric air blower 21 sucks air, and thereby sends air from the upstream side to the downstream side in the vacuum cleaner.

Figure 2:
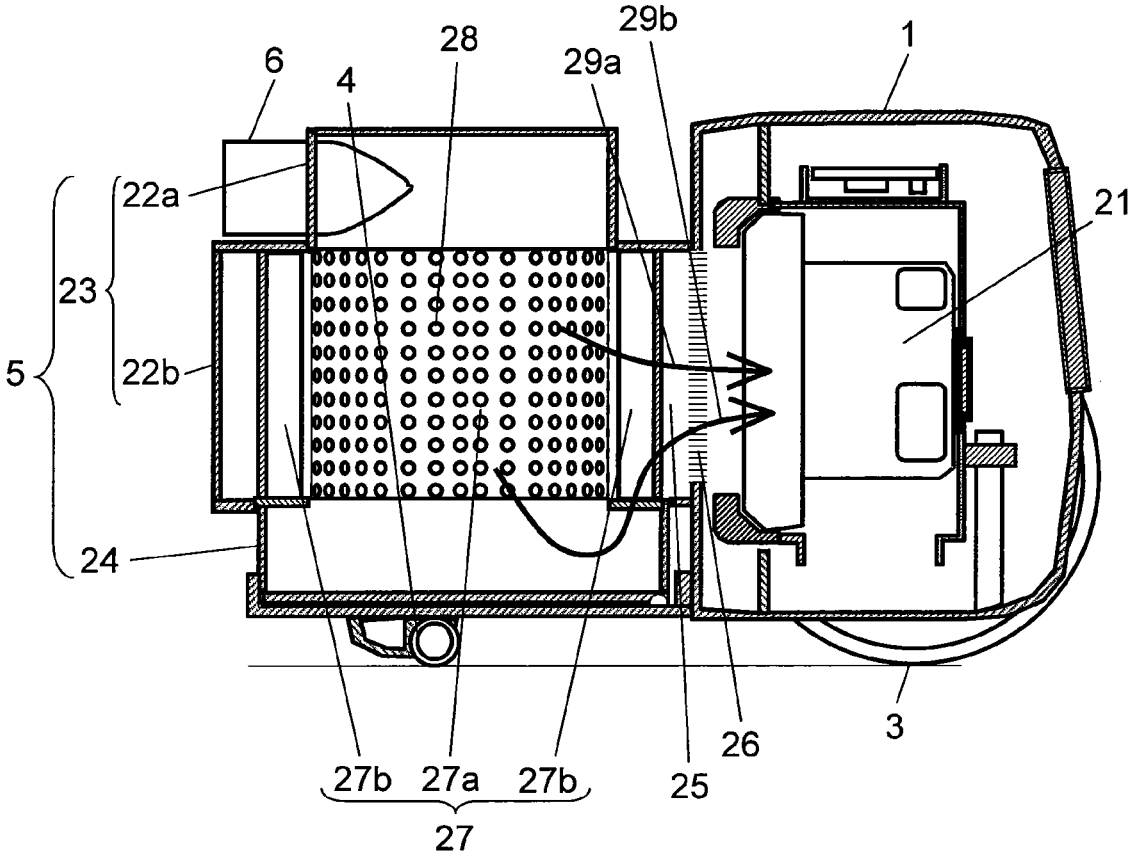
FIG. 2 is a sectional view showing a configuration of a principal part of a main body of the vacuum cleaner.

FIG. 2 is a sectional view showing a configuration of a principal part of a vacuum cleaner main body in accordance with the first exemplary embodiment of the present invention. Cleaner main body 1 includes electric air blower 21 for generating suction airflow. Furthermore, wheels 3 and casters 4 are mounted on the outside of cleaner main body 1, so that cleaner main body 1 can move freely on the floor. Dust collecting case 5 is detachably installed to cleaner main body 1 at the upstream side of electric air blower 21 via partition wall 26 having air holes. Dust collecting case 5 takes in dust-containing air sucked by electric air blower 21.

Furthermore, dust collecting case 5 is formed by arranging a plurality of hollow cylinders having different diameters in multi stages. The first exemplary embodiment of the present invention employs a three-stage configuration. The three-stage configuration includes case upper part 22*a*, case middle part 22*b*, and dust accommodating section 24 in this order from the top stage. Case upper part 22*a* and case middle part 22*b* constitute dust separator 23. Case upper part 22*a* is provided with suction port 6 that takes in dust-containing air from the tangent direction.

Dust collecting case 5 communicates from suction port 6 to dust accommodating section 24 on the bottom stage for accumulating dust. An air passage from suction port 6 to electric air blower 21 communicates with partition wall 26 of cleaner main body 1 at opening 25 provided at dust separator 23 in dust collecting case 5. Furthermore, dust separator 23 is provided with cylindrical filtration filter 27. In this way, dust separator 23 is placed at the upstream side from electric air blower 21, takes in dust-containing air sucked by electric air blower 21, and then separates dust from the air by filtration filter 27. Dust accommodating section 24 accommodates dust separated by dust separator 23.

In the first exemplary embodiment of the present invention, cylindrical filtration filter 27 is formed of two layers, that is, cylindrical first filtration filter 27*a* as a rough dust filter disposed at the upstream side, and cylindrical second filtration filter 27*b* as a fine dust filter disposed on the outer periphery at the downstream side from the first filtration filter.

First filtration filter 27*a* and second filtration filter 27*b* are disposed in the middle of main air passage 29*a* that is a first air passage in which suction port 6 of dust collecting case 5 communicates with electric air blower 21.

Main air passage 29*a* from suction port 6 to electric air blower 21 is provided along the entire periphery of space stretching from the inside of first filtration filter 27*a* to the outer periphery of second filtration filter 27*b*.

Figure 3A:
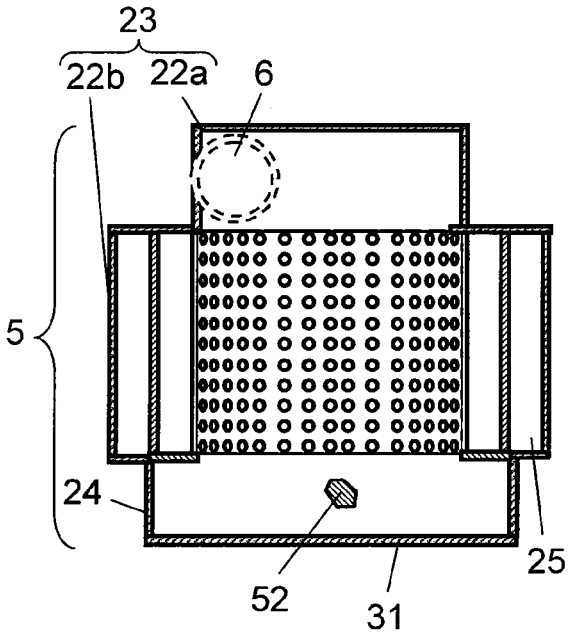
FIG. 3A is a front sectional view showing a dust collecting case of the vacuum cleaner.
Figure 3B:
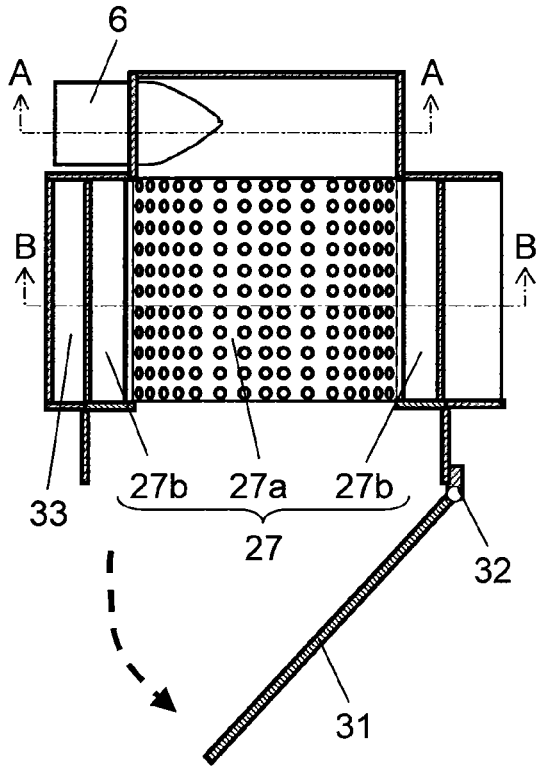
FIG. 3B is a side sectional view showing a dust collecting case of the vacuum cleaner.
Figure 3C:
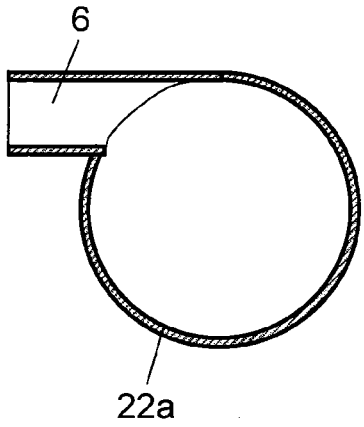
FIG. 3C is a sectional view taken along line A-A in FIG. 3B.
Figure 3D:
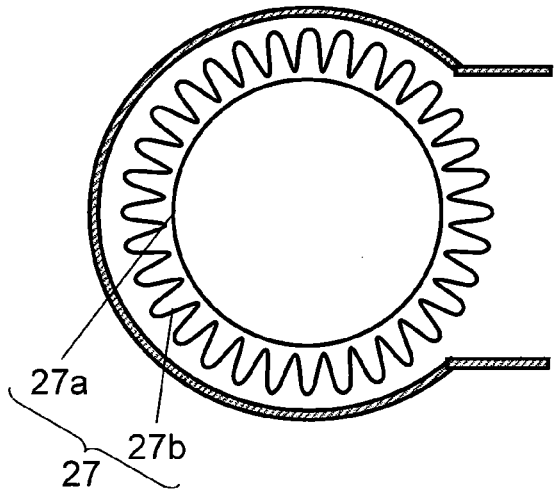
FIG. 3D is a sectional view taken along line B-B in FIG. 3B.

Next, dust collecting case 5 and cylindrical filtration filter 27 are detailed. FIG. 3A is a front sectional view showing a dust collecting case of a vacuum cleaner in accordance with the first exemplary embodiment of the present invention; FIG. 3B is a side sectional view showing the dust collecting case of the vacuum cleaner; FIG. 3C is a sectional view taken along line A-A in FIG. 3B; and FIG. 3D is a sectional view taken along line B-B in FIG. 3B.

As shown in FIG. 3A, dust collecting case 5 is formed by arranging vertical hollow cylinders in three stages. Furthermore, suction port 6 is disposed at an off-center position so that airflow enters from the tangent direction of the circumference of a circle of case upper part 22*a* as shown in FIG. 3C.

In the first exemplary embodiment of the present invention, dust collecting case 5 has a hollow cylindrical shape. However, the shape of the cylinder is not necessarily limited to a perfect circle, and it may be an ellipse, or a polygon such as an octagon or a decagon. Any shape is acceptable as long as it allows the airflow entering from suction port 6 in the tangent direction of dust collecting case 5 generate a whirling air current along the inner surface of dust collecting case 5.

Similarly, cylindrical filtration filter 27 is not necessarily limited to a perfect circle, and it may be an ellipse, or a polygon such as an octagon or a decagon. Any shape is acceptable as long as it allows the whirling air current generated along the inner surface of dust collecting case 5 to be generated also in the hollow cylinder in first filtration filter 27*a*.

Furthermore, suction port 6 may be located in the middle of case upper part 22*a*, and a guideway, a guide, and the like, may be provided so as to generate a whirling air current. A rotor may be provided in the middle of case upper part 22*a* so as to forcibly generate a whirling air current. In short, any configuration may be acceptable as long as a whirling air current is generated in the airflow passage.

Therefore, dust separator 23 is provided with a passage for whirling air current through which a whirling air current generated along the inner surface of case upper part 22*a* and a whirling air current generated in the cylindrical hollow section in first filtration filter 27*a*. Furthermore, cylindrical filtration filter 27 constitutes at least a part of the whirling air current passage.

Suction port 6 is provided in case upper part 22*a* so as to generate a whirling air current from case upper part 22*a* toward dust collector 24. Suction port 6 is disposed such that the lower end of suction port 6 is placed at the upper portion from the upper end portion of opening 25 provided to dust separator 23. When the position of suction port 6 is placed higher than opening 25 in this way, air taken from suction port 6 along the tangent direction of upper part 22*a* becomes a whirling air current in the direction toward dust collector 24, that is, a whirling air current in the downward direction, by the effect of suction force at opening 25 side. By the whirling air current that continues to descends while whirling, rough dust 52 such as cotton lint descends while whirling and is guided to dust collector 24 under air pressure.

Dust collecting case 5 has dust collector 24 for accumulating sucked dust at the bottom thereof. Furthermore, the bottom surface of dust collecting case 5 at dust collector 24 side functions as door 31. Door 31 is opened via hinge 32 so that the dust accumulated in dust collector 24 can be discharged.

Dust collecting case 5 is made of acrylic resin in the first exemplary embodiment of the present invention. It is preferable that at least a part of dust collecting case 5 is made of a transparent member because an amount of dust can be easily checked from the upper part by visual inspection. The transparent member is preferably ABS (Acrylonitrile-Butadiene-Styrene) resin, polypropylene, acrylic resin, and the like, because they are easily available and excellent in workability.

Furthermore, as shown in FIG. 3B, on the inner wall between suction port 6 and dust collector 24 of cylindrical dust collecting case 5, space 33 is formed on the entire outer periphery between dust collecting case 5 and cylindrical filtration filter 27. Thus, the inside of dust collecting case 5 communicates with the suction port of electric air blower 21 via this space 33. Herein, space 33 is space in which a suction force of electric air blower 21 acts on.

Furthermore, the inner surface of case upper part 22*a* of dust collecting case 5 and the inner surface of first filtration filter 27*a* constituting cylindrical filtration filter 27 are integrated with each other as a whole.

As shown in FIG. 3D, cylindrical filtration filter 27 has a cylindrical shape surrounding the inside of cylindrical dust collecting case 5. First filtration filter 27*a* as a rough dust filter located at the upstream side with respect to suction airflow removes relatively large dust such as cotton dust and hair from the suction airflow. Second filtration filter 27*b* as a fine dust filter located at the downstream side removes dust having small particle diameter, for example, grains of sand, pollens and tick-droppings from the airflow.

As mentioned above, use of cylindrical filtration filter 27 having a plurality of layers according to the size of dust to be removed can reduce the frequency of clogging of the filtration filter, so that the performance of maintaining the air volume can be extended. However, the filtration filter may be a single-layer filter.

First filtration filter 27*a* is preferably made of a metal mesh, punching metal, a resin mesh, and the like, having a relatively large hole diameter so that fine dust such as grains of sand can pass through. In the first exemplary embodiment of the present invention, a metal mesh having small air holes with a hole diameter of 100 micron to 300 micron is used.

Second filtration filter 27*b* can be made of a non-woven fabric, pulp, glass fiber, an HEPA (High Efficiency Particulate Air) filter, and the like. For example, members formed by pleating and folding a non-woven fabric member and the like capable of efficiently removing relatively fine particles are linked and placed in a cylindrical shape. Thus, the air permeability resistance can be reduced while dust removing performance can be secured.

It is more preferable to use a filter coated with a thin PTFE (polytetrafluoroethylene) film as porous member on the surface of the filter to which dust is to be attached because the removal of dust is improved, so that clogging of second filtration filter 27*b* can be inhibited.

Figure 4:
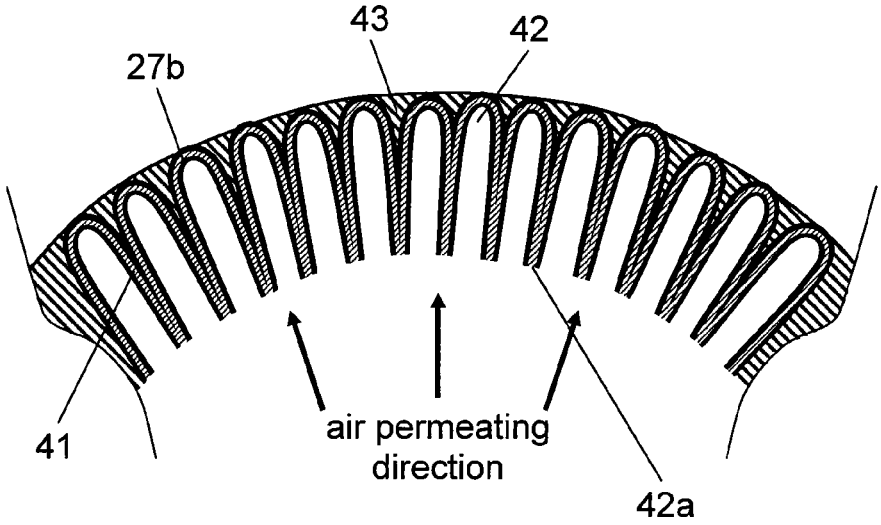
FIG. 4 is a sectional view showing a principal part of a second filtration filter of the vacuum cleaner in accordance with the first exemplary embodiment of the present invention.

FIG. 4 is a sectional view showing a principal part of a second filtration filter of the vacuum cleaner in accordance with the first exemplary embodiment of the present invention. In the first exemplary embodiment of the present invention, as shown in FIGS. 3D and 4, a non-woven fabric made of PET (Polyethylene Terephthalate) resin fiber provides rigidity. A sheet-like filter is formed by coating a surface to which dust is to be attached of the non-woven fabric with a PTFE film that has holes penetrating from the front surface to the rear surface of the film and having a hole diameter of about 0.5 micron. The sheet-like filter is formed into pleated filter 41 by pleating processing, and then both end parts of filter 41 are coupled to each other so as form a cylindrical shape.

At the outer periphery of pleated filter 41, dents 42 are formed on the inner surface of the pleated member located on the upstream side of the suction airflow. Dent 42 has a rounded like a substantially U-letter shape with R=2 mm-5 mm. Furthermore, dents 42*a* at the side closer to first filtration filter 27*a* in pleated filter 41 is not particularly formed in a U-letter shape.

The outer periphery of pleated filter 41 as second filtration filter 27*b* is provided with seal portion 43 that is sealed with resin and sealing material and the like only in the range of several mm of the upper and lower ends thereof. As a result, air permeability from the vertical direction is blocked, thus blocking leakage that tends to occur between the outer periphery of pleated filter 41 and dust collecting case 5.

Figure 5A:
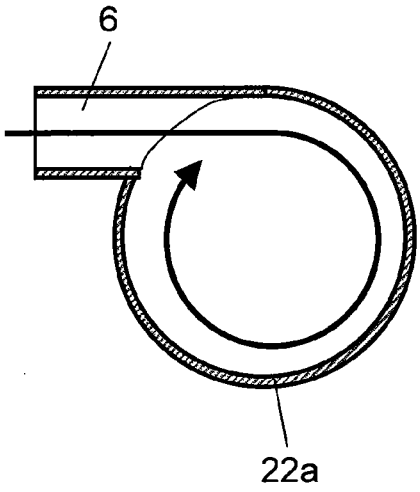
FIG. 5A is a cross-sectional view showing airflow in the vicinity of a suction port in the dust collecting case of the vacuum cleaner.
Figure 5B:
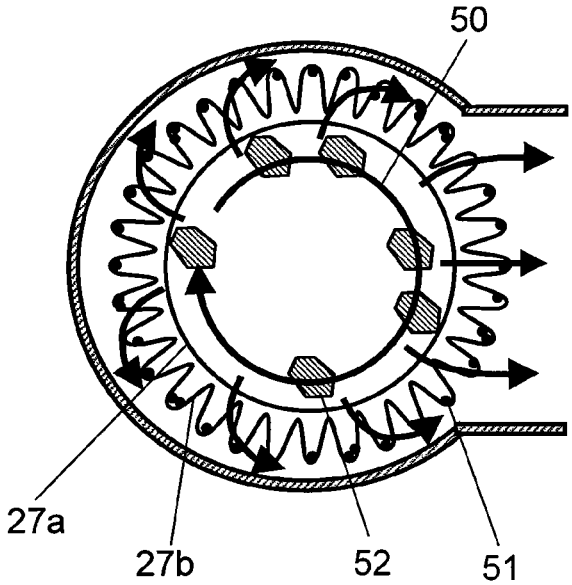
FIG. 5B is a cross-sectional view showing stream of airflow in the vicinity of a filtration filter in the dust collecting case of the vacuum cleaner.
Figure 5C:
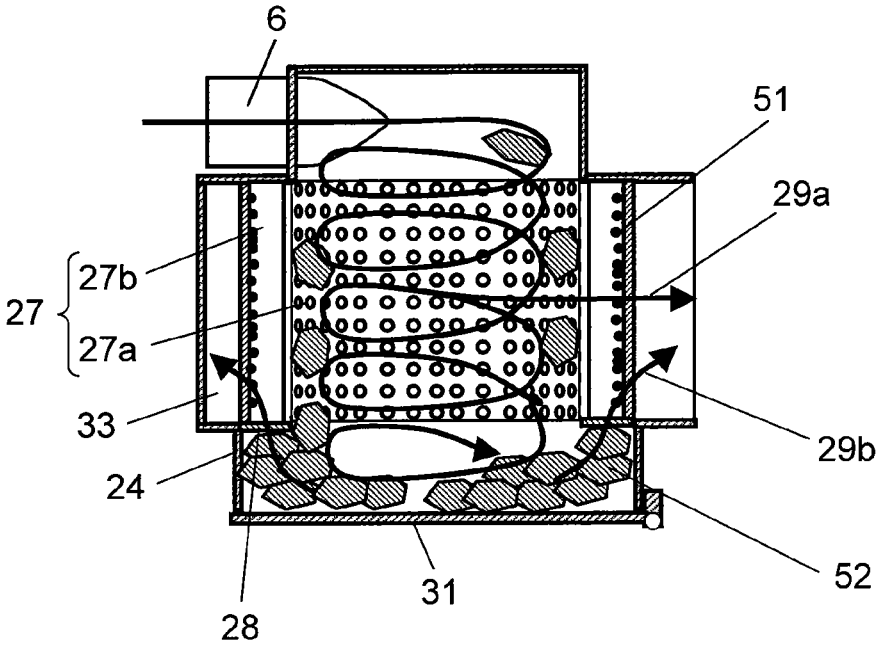
FIG. 5C is a longitudinal sectional view showing a stream of airflow in the vertical direction in the dust collecting case of the vacuum cleaner.

An operation of the vacuum cleaner configured as mentioned above in accordance with the first exemplary embodiment of the present invention is described with reference to FIG. 1 and FIGS. 5A to 5C. FIG. 5A is a cross-sectional view showing airflow in the vicinity of a suction port in the dust collecting case of the vacuum cleaner in accordance with the first exemplary embodiment of the present invention; FIG. 5B is a cross-sectional view showing a stream of airflow in the vicinity of a filtration filter in the dust collecting case of the vacuum cleaner; and FIG. 5C is a longitudinal sectional view showing a stream of airflow in the vertical direction in the dust collecting case of the vacuum cleaner.

By operating electric air blower 21, suction airflow is generated, and air including dust on the floor is sucked into dust collecting case 5 via suction tool 9, extension tube 8, and suction hose 7. At this time, suction port 6 of dust collecting case 5 is disposed off-center with respect to the tangent direction of the cross section of the cylindrical case upper part 22*a* of dust collecting case 5. Therefore, as shown in FIG. 5A, the airflow flowing into suction port 6 enters dust collecting case 5 from the tangent direction of the cross section of the cylindrical dust collecting case 5, and then is changed into a whirling air current.

Herein, since the lower end of suction port 6 is disposed at the upper part from the upper end of opening 25, the airflow flowing from suction port 6 has a whiling component and a downward component. Therefore, the whirling air current generated in case upper part 22*a* of dust collecting case 5 continues to descend while whirling and reaches the vicinity of cylindrical filtration filter 27. Herein, since first filtration filter 27*a* located at the upstream side of cylindrical filtration filter 27 has no protrusion toward the inside of dust collecting case 5, the stream of the whirling air current is not stopped. Then, as shown in FIG. 5B, the airflow continues to whirl, passes through first filtration filter 27*a* and second filtration filter 27*b* sequentially, then passes through space 33, and is sucked by electric air blower 21.

The dust sucked together with the suction airflow whirls along with the stream of airflow and is guided to cylindrical filtration filter 27. Among the dust, fine dust 51 such as grains of sand passes through first filtration filter 27*a* and is filtered out by second filtration filter 27*b* disposed outside.

Rough dust 52 such as cotton dust and thread-like dust having a small specific gravity and susceptible to air pressure is easily removed from the surface of first filtration filter 27*a* by whirling air current. Then, as shown in FIGS. 5B and 5C, rough dust 52 continues to whirl in a hollow cylinder of first filtration filter 27*a*. This operation provides first filtration filter 27*a* with self-cleansing function by airflow, so that no clogging occurs and a decrease in suction force can be suppressed. In addition, as an amount of sucked dust increases, rough dust 52 descends while whirling in first filtration filter 27*a* and is guided to dust collector 24.

Figure 6A:
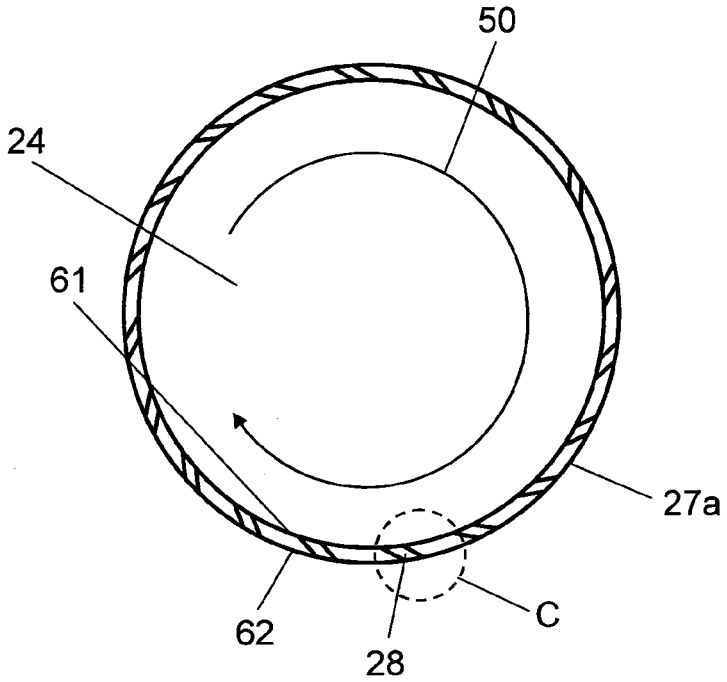
FIG. 6A is a sectional view showing a principal part of a structure of the filtration filter of the vacuum cleaner.

Next, first filtration filter 27*a* is detailed. FIG. 6A is a sectional view showing a principal part of the structure of the filtration filter of the vacuum cleaner in accordance with the first exemplary embodiment of the present invention; and FIG. 6B is a sectional view of a principal part of the filtration filter showing an enlarged C part of FIG. 6A.

In cylindrical first filtration filter 27*a* as a filtration filter, when the inner peripheral surface is defined as upstream filter surface 61 and the outer peripheral surface is defined as downstream filter surface 62, the inner peripheral side of first filtration filter 27*a* is located in the upper part of dust accommodating section 24. Herein, in the inner peripheral side of first filtration filter 27*a*, whirling air current 50 whirls along upstream filter surface 61. Outer peripheral side of first filtration filter 27*a* is provided with an airflow passage of air that has passed through first filtration filter 27*a*. In the airflow passage, second filtration filter 27*b* is disposed. At the downstream side thereof, electric air blower 21 is disposed. On the substantially entire surface of first filtration filter 27*a*, a plurality of inclined through-holes 28 are dispersed. Through hole 28 penetrates from upstream filter surface 61 as the surface at the upstream side to downstream filter surface 62 as the surface at the downstream side.

Figure 6B:
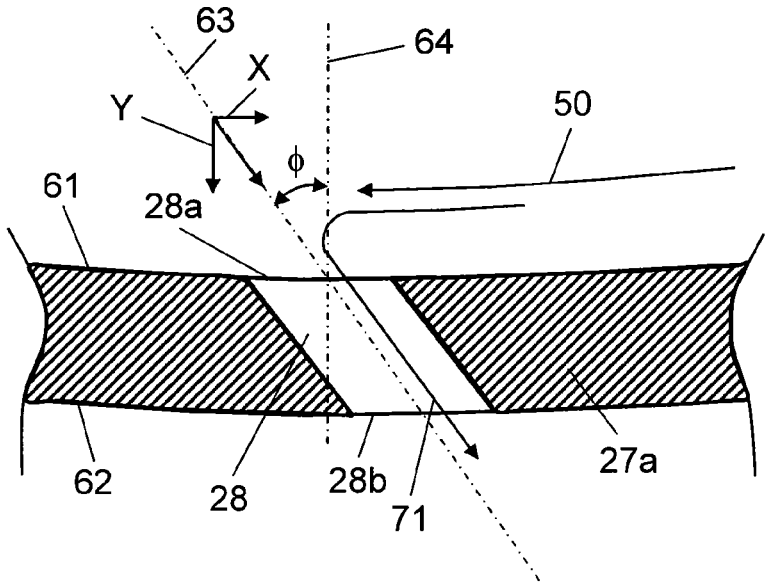
FIG. 6B is a sectional view of a principal part of the filtration filter showing an enlarged C part of FIG. 6A.

As shown in FIG. 6B, through-hole 28 of first filtration filter 27*a* is provided so that central axis 63 of through-hole 28 is inclined at inclined angle Φ with respect to normal line 64 of the filter surface.

The X-direction component in the streamline vector penetrating from upstream hole 28*a* to downstream hole 28*b* is opposite to the direction in which the whirling air current moves.

Figure 7A:
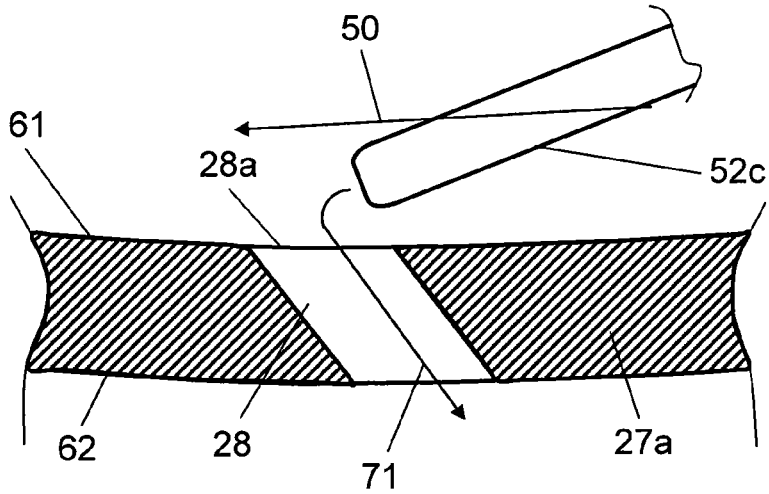
FIG. 7A is a view to illustrate a separation operation for separating thread-like dust of the vacuum cleaner in accordance with the first exemplary embodiment of the present invention.
Figure 7B:
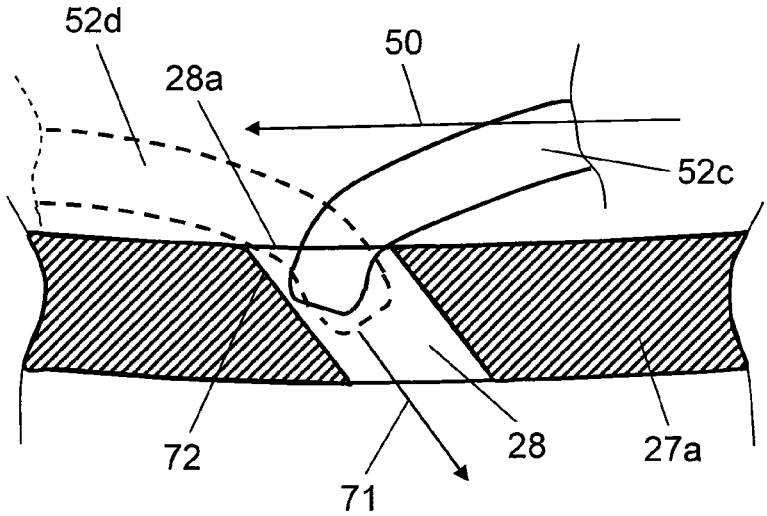
FIG. 7B is a view to illustrate a separation operation for separating thread-like dust of the vacuum cleaner.

The thus configured first filtration filter 27*a* operates as follows. FIGS. 7A and 7B are views to illustrate a separation operation for separating thread-like dust by vacuum cleaner in accordance with the first exemplary embodiment of the present invention.

As shown in FIG. 7A, long thin thread-like dust 52*c* such as hair whirls at the upstream side of filtration filter 27*a* by whirling air current 50. A part of whirling air current 50 turns up in the vicinity of upstream hole 28*a* of through-hole 28 and flows in through-hole 28, and passes through to the downstream side as suction airflow 71.

Then, as shown in FIG. 7B, when thread-like dust 52*c* approaches through-hole 28, the head portion of thread-like dust 52*c* is pulled into through-hole 28 by suction airflow 71. Herein, through-hole 28 penetrating from upstream hole 28*a* to downstream hole 28*b* is inclined so as to be in the opposite direction to the direction in which the whirling air current moves. Therefore, when thread-like dust 52*c* whirling by the whirling air current attempts to enter through-hole 28, the head portion of long thin thread-like dust 52*c* collides with inclined surface 72 inside the entering portion of through-hole 28, and is prevented from entering a deep portion of through-hole 28.

Furthermore, since thread-like dust 52*c* whirls by the whirling air current and has an inertial force, once it collides with inclined surface 72 inside of the entrance of through-hole 28, thread-like dust 52*c* attempts to pass through-hole 28 by the effect of the inertial force. Furthermore, a part other than the head portion of thread-like dust 52*c* receives also a pushing force by whirling air current 50, and is carried toward the front of through-hole 28. Thread-like dust 52*d*, which has been carried toward the front, pulls the head portion that is being pulled into through-hole 28 to the opposite direction by the force of whirling air current 50.

The strong force of whirling air current 50 applied to the portion other than the head portion of thread-like dust 52*c* pulls the head portion of thread-like dust 52*c*, which shallowly enters through-hole 28, to the upstream side. Thus, the head portion of thread-like dust 52*c* runs through inclined surface 72 of through-hole 28 such that it slides thereon and is pulled back to the inside of first filtration filter 27*a*.

Thereafter, thread-like dust 52*c* continues to whirl by whirling air current 50 in first filtration filter 27*a*, gradually descends by gravity, and then is collected in dust accommodating section 24 disposed at the bottom.

On the contrary, in the case of the short-length thread-like dust 52*c*, once thread-like dust 52*c* enters through-hole 28, it is sucked by suction airflow 71 inside through-hole 28. Then, thread-like dust 52*c* passes through first filtration filter 27*a* and reaches second filtration filter 27*b* disposed at the downstream side.

Furthermore, the inertial force by the whirling air current has a stronger effect on dust having large specific gravity and being susceptible to an inertial force as mentioned above. For example, dust with larger specific gravity than that of thread-like dust 52*c*, for example, sand dust, and the like, receives an inertial force by the whirling air current strongly and passes through through-hole 28 vigorously. As a result, such dust is not pulled by sucking force of suction airflow 71.

Next, the inclined direction of through-hole 28 is detailed with reference to FIG. 8. FIGS. 8A and 8B are views to illustrate the inclined direction of the through-hole of the first filtration filter of the vacuum cleaner in accordance with the first exemplary embodiment of the present invention. FIGS. 8A and 8B are schematic views of enlarged image showing the inclined direction of through-hole 28 in a state in which first filtration filter 27*a* is installed in dust separator 23. These views are seen from the inside (upstream side) of cylindrical first filtration filter 27*a*.

Figure 8A:
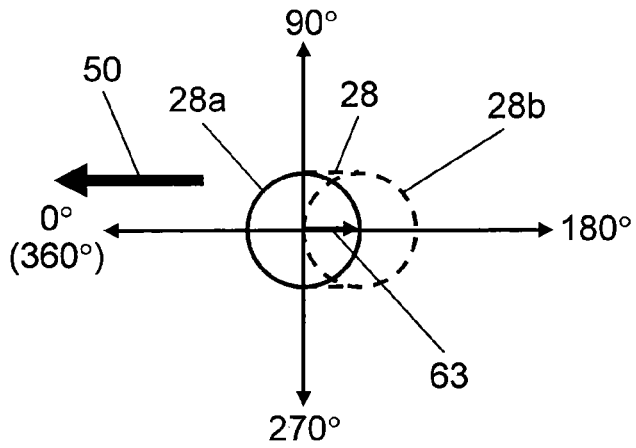
FIG. 8A is a view to illustrate an inclined direction of a through-hole of a first filtration filter of the vacuum cleaner.

As shown in FIG. 8A, when first filtration filter 27*a* is disposed so that the direction of central axis 63 of through-hole 28 extending from upstream hole 28*a* to downstream hole 28*b* is the opposite direction (180°) to the direction in which whirling air current 50 moves, an effect of preventing clogging of dust in through-hole 28 can be obtained most effectively. This is because thread-like dust 52*c* that begins to enter the inside of through-hole 28 is pulled back to the upstream side of first filtration filter 27*a* by an inertial force or a force of whirling air current 50.

However, as shown in FIG. 5C, the direction in which the whirling air current moves has also a direction component descending toward dust accommodating section 24 while whirling. Therefore, as shown in FIG. 8B, the direction in which whirling air current 50 moves is directed to the left lower part. Consequently, whirling air current descends while whirling counterclockwise. In this state, when the direction of central axis 63 of through-hole 28 is still disposed as in FIG. 8A, a dust entering preventing effect, that is, an effect of allowing dust to collide with inclined surface 72 inside the entrance of through-hole 28 so as to prevent dust from entering a deeper portion (downstream side) of through-hole 28, is reduced as compared with the opposite direction (180°).

Figure 8B:
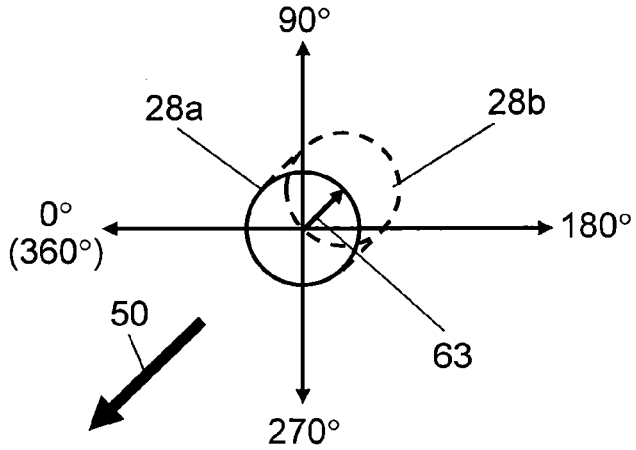
FIG. 8B is a view to illustrate an inclined direction of a through-hole of a first filtration filter of the vacuum cleaner.

Therefore, as shown in FIG. 8B, in a state in which whirling air current descends while whirling counterclockwise, it is desirable that through-hole 28 in first filtration filter 27*a* is disposed so that the direction of central axis 63 of through-hole 28 is the opposite direction (180°) to the direction in which whirling air current 50 moves.

Furthermore, as downstream hole 28*b* is changed such that the direction of central axis 63 of through-hole 28 in FIG. 8A is changed from the opposite direction (180°) as the standard, which is opposite to the direction in which whirling air current 50 moves, toward the 90° direction and 270° direction, the dust entering preventing effect is reduced. The dust entering preventing effect can be achieved preferably when the direction of the central axis is in the range to the direction perpendicular to the direction in which dust whirling air current 50 moves. When the direction of the central axis is in the range from 0° to 90° and the range of 270° to 360°, whirling air current 50 exerts an effect of pushing dust into through-hole 28, causing a contrary effect.

As described above, since through-hole 28 having an inclined angle with respect to the normal line direction of first filtration filter 27*a* prevents thread-like dust 52*c* from entering, it is possible to inhibit thread-like dust 52*c* from being stuck and tangled in through-hole 28 or clogging in through-hole 28. Therefore, when dust is discharged after cleaning work, the dust is not tangled in through-hole 28 of first filtration filter 27*a*, so that dust including thread-like dust 52*c* can be easily discharged.

Furthermore, it is possible to avoid the propagation of bacteria which causes insanitary condition or reduction in the accommodation volume of dust, which has been secured, due to residence of dust in first filtration filter 27*a*. In addition, since the air permeability of first filtration filter 27*a* can be maintained, a vacuum cleaner that does not cause reduction in the air volume and that can keep a strong suction force for a long time can be provided.

Second Exemplary Embodiment

Figure 9:
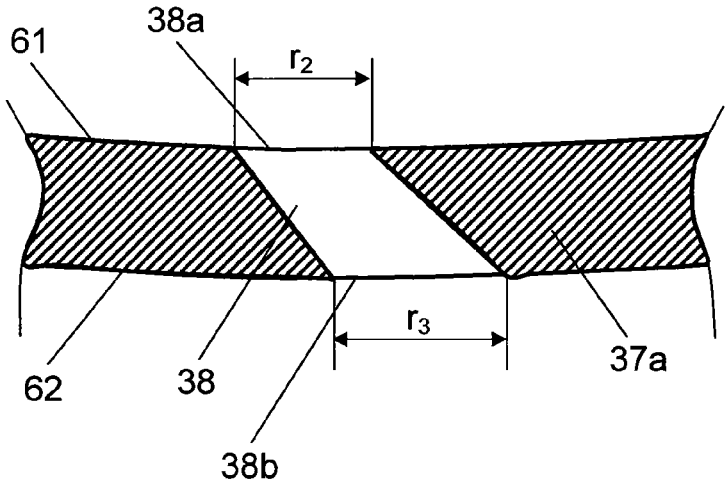
FIG. 9 is a sectional view of a principal part showing a sectional structure of a first filtration filter in accordance with a second exemplary embodiment of the present invention.

Next, a vacuum cleaner in accordance with a second exemplary embodiment of the present invention is described with reference to FIG. 9. FIG. 9 is a sectional view of a principal part showing a sectional structure of a first filtration filter in accordance with a second exemplary embodiment of the present invention. FIG. 9 is a sectional view showing a principal part by enlarging through-hole 38 of first filtration filter 37*a*, which is a modified view of FIG. 6.

The configuration of the vacuum cleaner in accordance with the second exemplary embodiment of the present invention is the same as the configuration of the vacuum cleaner of the first exemplary embodiment shown in FIGS. 1 to 5. The same reference numerals are given to the same configuration as those in the first exemplary embodiment and the description thereof is omitted.

Through-hole 38 has a shape that opens toward the downstream side of first filtration filter 37*a*, that is, a shape in which hole diameter $r_3$ of the downstream hole is larger than hole diameter $r_2$ of the upstream hole. It is preferable that the ratio of the hole diameters $r_3/r_2$ is made to be not more than 2. When hole diameter $r_3$ of the downstream hole in through-hole 38 is made to be larger, the friction between the inside of downstream hole of through-hole 38 and thread-like dust 52*c* can be reduced. Dust that has passed through upstream hole 38*a* having an effective diameter can easily flow to the downstream side, and removal of dust is improved. Therefore, the possibility that clogging of through-hole 38 with dust occurs can be reduced.

Furthermore, when hole diameter $r_3$ of the downstream hole is larger than hole diameter $r_2$ of the upstream hole, the internal volume of through-hole 38 can be increased while dust is prevented from entering at the upstream side. Therefore, the air-permeation pressure loss of the airflow flowing in through-hole 38 can be reduced. Thus, both prevention of dust from entering and reduction in air-permeation pressure loss can be achieved.

Third Exemplary Embodiment

Next, a method of manufacturing a first filtration filter is described with reference to FIG. 10. FIG. 10A to FIG. 10C are sectional process views to illustrate a method of manufacturing a first filtration filter of a vacuum cleaner in accordance with a third exemplary embodiment of the present invention.

The configuration of the vacuum cleaner in accordance with the third exemplary embodiment of the present invention is the same as the configuration of the vacuum cleaner of the first exemplary embodiment of the present invention. The same reference numerals are given to the same configuration as those in the first exemplary embodiment and the description thereof is omitted.

Figure 10A:
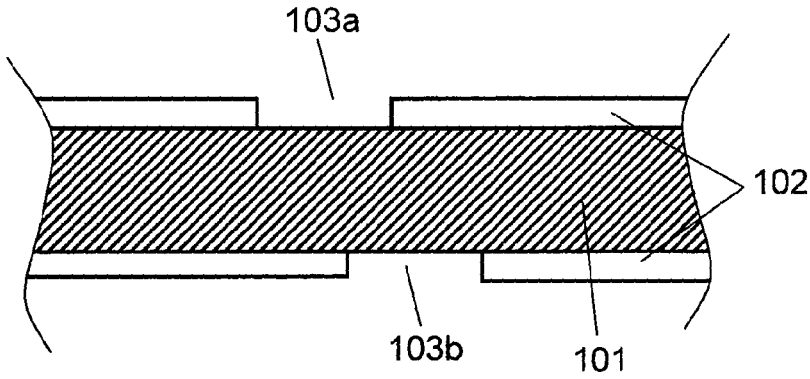
FIG. 10A is a sectional process view to illustrate a method of manufacturing a first filtration filter of a vacuum cleaner in accordance with a third exemplary embodiment of the present invention.
Figure 10B:
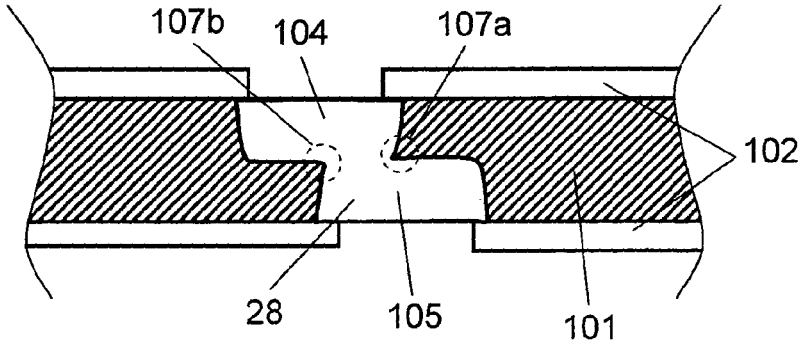
FIG. 10B is a sectional process view to illustrate the method of manufacturing the first filtration filter of the vacuum cleaner.
Figure 10C:
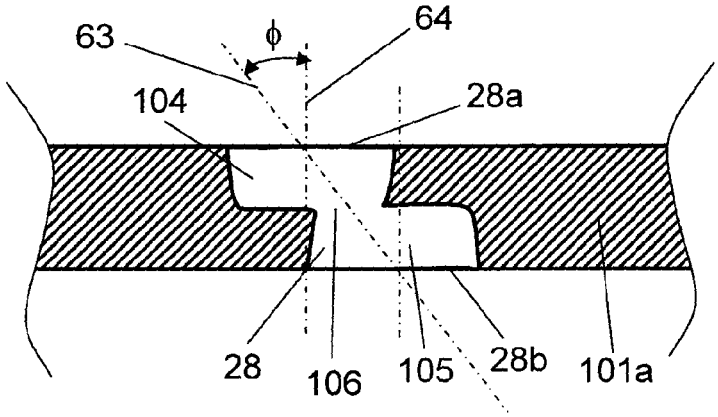
FIG. 10C is a sectional process view to illustrate the method of manufacturing the first filtration filter of the vacuum cleaner.

FIG. 10A to FIG. 10C are process views showing a process order of etching process of the first filtration filter. In FIG. 10A, resist is coated on the front and rear surfaces of metal plate 101 having a thickness of 0.1 mm to 0.3 mm. Then, by an exposure process, resist patterns 102 are formed on the front and rear surfaces of metal plate 101. Resist patterns 102 have openings 103*a* and 103*b* (diameter: 0.1 mm to 0.3 mm) whose positions in the plane direction are shifted from each other.

Next, as shown in FIG. 10B, etching is carried out with an etchant from both the front surface and the rear surface of metal plate 101. When the etching from both surfaces of metal plate 101 proceeds and first etched hole 104 etched from the front surface and second etched hole 105 etched from the rear surface are combined with each other, through-hole 28 linking the front surface to the rear surface is formed in metal plate 101.

Then, as shown in FIG. 10C, at the time when through-hole 28 is formed, etching with an etchant is completed. Then, resist pattern 102 is removed and etching process is completed.

After this process, an etchant is poured or injected from one side to the other of through-hole 28 so as to carry out finish etching. By the finish etching, edge parts 107*a* and 107*b* formed on the boundary between first etched hole (upstream hole) 104 and second etched hole (downstream hole) 105 shown in FIG. 10B are removed. As a result, communicating portion 106 becomes smooth and the shape can be approximated to a shape like inclined surface 72 of through-hole 28 shown in FIG. 7B.

Filtration filter 101*a* immediately after etching has a flat plate shape. The flat plate-shaped metal plate has a plurality of inclined through-holes 28 that are dispersed over the entire filter surface. As shown in FIG. 10C, in through-hole 28, upstream hole 28*a* and downstream hole 28*b* are shifted from each other in the plane direction. Therefore, through-hole 28 is formed so that central axis 63 of through-hole 28 linking a center point of the opening of upstream hole 28*a* to a center point of the opening of downstream hole 28*b* has an inclined angle $\phi$ with respect to normal line 64 of the filter surface.

Then, when filtration filter 101*a* is placed in dust collecting case 5 of a vacuum cleaner, the flat plate-shaped filtration filter 101*a* is incorporated into dust separator 23 in a state in which it is rounded in a cylindrical shape and is used as cylindrical first filtration filter 27*a*.

In the thus formed through-hole 28 of first filtration filter 27*a*, the hole diameter of the part of communicating part 106 communicating first etched hole (upstream hole) 104 at the front surface side with second etched hole (downstream hole) 105 at the rear surface side is small, and the hole diameters of upstream hole 104 and downstream hole 105 become larger. Therefore, the hole diameter of communicating part 106 whose hole diameter is smaller is an effective diameter providing the filter effect. Thus, through-hole 28 includes upstream hole 104 formed at the upstream surface, downstream hole 105 formed at the downstream surface, and communicating part 106 communicating upstream hole 104 with downstream hole 105. The hole diameter of communicating part 106 is smaller than the hole diameters of upstream hole 104 and downstream hole 105.

Furthermore, since first filtration filter 27*a* formed by etching processing is not subjected to a mechanical stress during processing, a base material is not deformed during processing and the surface of first filtration filter 27*a* becomes smooth. Therefore, it is possible to inhibit dust from accumulating or being tangled in the surface of first filtration filter 27*a*. Therefore, when first filtration filter 27*a* is cleaned, dust can be removed easily. The frequency of cleaning can be reduced. The filtration filter can be used in a vacuum cleaner as a filtration filter excellent in the maintenance property.

When metal plate 101 is used as a base material of first filtration filter 27*a*, it is possible to inhibit the attachment of dust, in particular, fine dust, to first filtration filter 27*a* with static electricity. Consequently, clogging of through-hole 28 may not easily occur. Furthermore, the base material of metal plate 101 is excellent in workability in, for example, punching, etching, and the like, so that the internal shape of through-hole 28 is formed to be smooth. Therefore, an effect of reducing entanglement of dust can be obtained.

Furthermore, formation can be easily carried out when a plate-shaped filter is formed in a cylindrical shape after the etching process, so that a filtration filter can be formed at a low cost. Even when a resin plate containing an antistatic agent, carbon black, an antistatic such as metal fine powder, or the like, is used as the base material of first filtration filter 27*a*, the same effect as the case where a metal plate is used can be obtained.

Figure 11A:
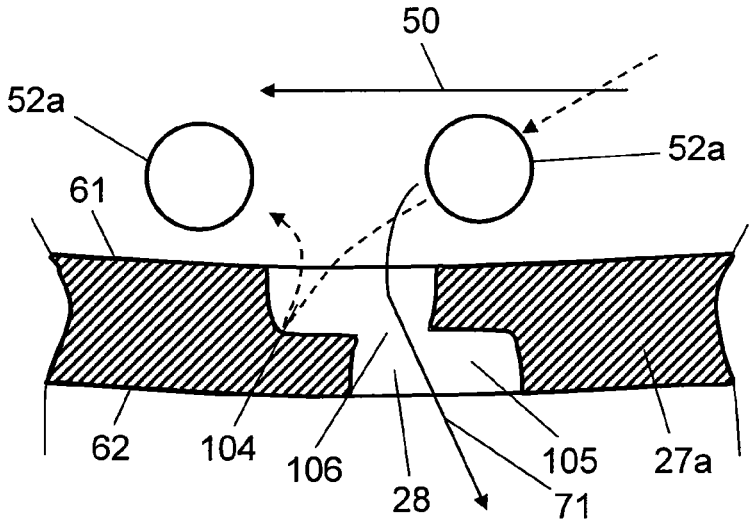
FIG. 11A is a view to illustrate a separation operation for separating large grain dust in the vacuum cleaner.
Figure 11B:
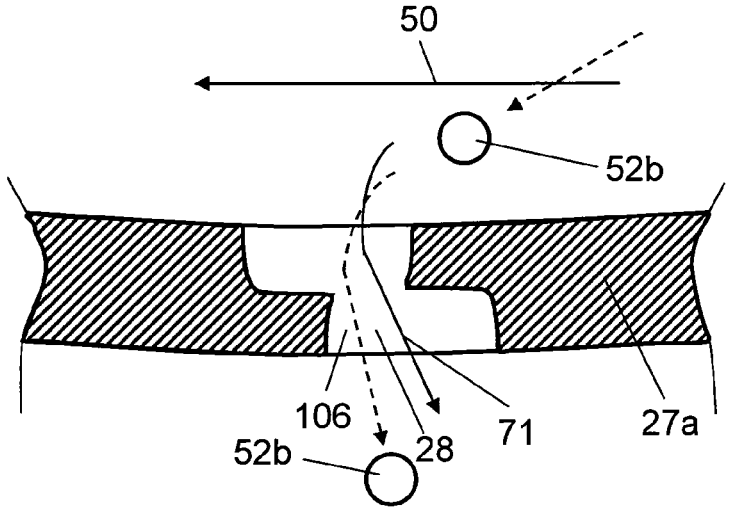
FIG. 11B is a view to illustrate a separation operation for separating small grain dust in the vacuum cleaner.

Next, an operation of first filtration filter 27*a* formed by the above-mentioned etching process is described with reference to FIGS. 11A, 11B, 12A, and 12B. FIG. 11A is a view to illustrate a separation operation for separating a large grain dust in the vacuum cleaner; and FIG. 11B is a view to illustrate a separation operation for separating a small grain dust in the vacuum cleaner.

As shown in FIG. 11A that is an enlarged view of a principal part showing one of through-holes 28 of cylindrical first filtration filter 27*a*, first filtration filter 27*a* has an inner peripheral surface as upstream filter surface 61 and an outer peripheral surface as downstream filter surface 62. Upstream filter surface 61 is located at the upper part of dust accommodating section 24 (not shown). Along upstream filter surface 61, whirling air current 50 is whirling.

Downstream filter surface 62 side forms an airflow passage of the air that has passed through first filtration filter 27*a*. At the downstream side of the airflow passage, second filtration filter 27*b* and electric air blower 21 (both are not shown) are disposed. Herein, through-hole 28 penetrates from upstream filter surface 61 at first filtration filter 27*a* to downstream filter surface 62, and the central axis of through-hole 28 is inclined. A plurality of through-holes 28 are formed in first filtration filter 27*a* in a state in which they are dispersed over the entire area.

As shown in FIG. 11A, when sucked dust is grain dust 52*a* such as sand grain having heavier specific gravity as compared with other dust, grain dust 52*a* whirls by whirling air current 50 in space at upstream filter surface 61 side. Most of the whirling grain dust 52*a* is subjected to a centrifugal force, and moves to the outer side from the direction in which whirling air current 50 flows and is thrown to upstream filter surface 61.

Then, grain dust 52*a* that approaches through-hole 28 of upstream filter surface 61 and attempts to enter through-hole 28 slightly changes its orbit by the influence of suction airflow 71 and then is drawn to communicating part 106 side. However, the force of moment of inertia due to whirling air current 50 is higher than suction airflow 71, so that grain dust 52*a* collides with the bottom surface of first etched hole 104 (recess of the upstream hole) and rebounds. As a result, grain dust 52*a* is thrown out to the outside of through-hole 28.

Grain dust 52*a* thrown out to the outside of through-hole 28 is carried toward the front from through-hole 28 by whirling air current 50, further continues to whirl by whirling air current 50, gradually descends by gravity, and is accommodated in dust accommodating section 24 located below.

As shown in FIG. 11B, when sucked dust is small grain dust 52*b* having light specific gravity, the force of moment of inertia by whirling air current 50 does not act largely on small grain dust 52*b*. Therefore, the orbit of dust 52*b* that approaches through-hole 28 by whirling air current 50 and enters through-hole 28 is largely changed by the effect of suction airflow 71. Then, dust 52*b* is drawn to communicating part 106 side and passes through through-hole 28. Dust 52*b* that has passed through through-hole 28 is carried to second filtration filter 27*b* located at the outer periphery of first filtration filter 27*a* and collected by second filtration filter 27*b*.

Figure 12A:
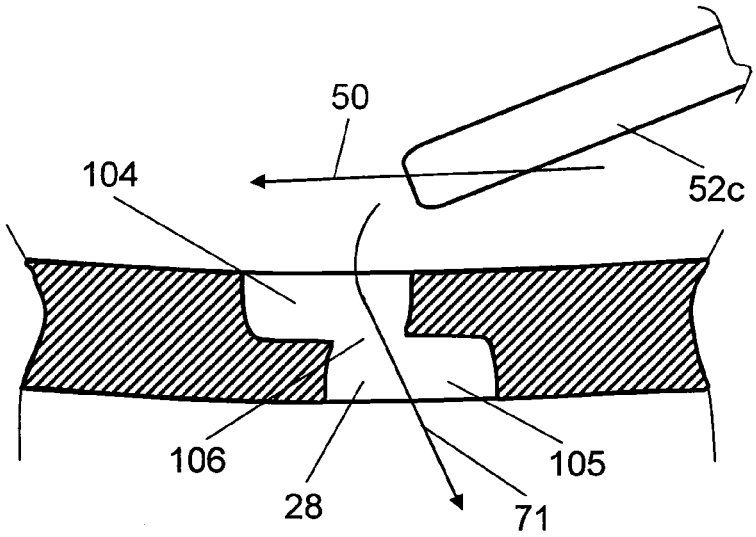
FIG. 12A is a view to illustrate a separation operation for separating thread-like dust in the vacuum cleaner.
Figure 12B:
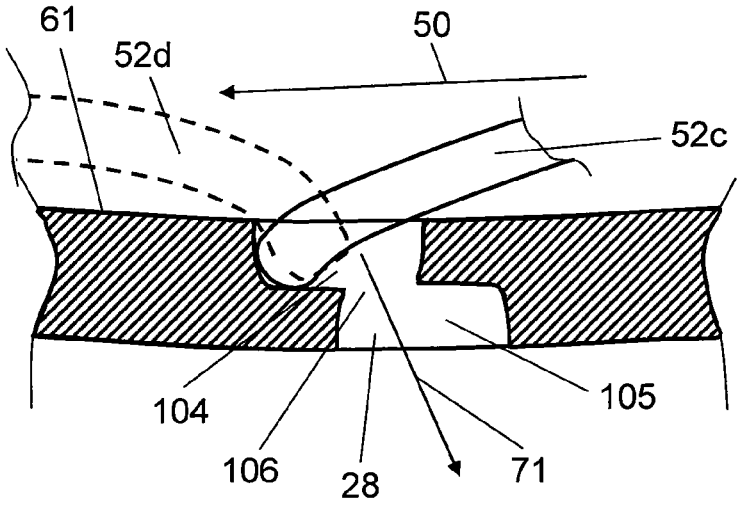
FIG. 12B is a view to illustrate a separation operation for separating thread-like dust in the vacuum cleaner.

Next, collection of thread-like dust is described. FIGS. 12A and 12B are views to illustrate a separation operation for separating thread-like dust in the vacuum cleaner in accordance with the third exemplary embodiment of the present invention.

As shown in FIG. 12A, when sucked dust is long thin thread-like dust 52*c* such as hair, thread-like dust 52*c* whirls by the stream of whirling air current 50. Then, as shown in FIG. 12B, the head part of thread-like dust 52*c* approaches through-hole 28 and enters inside through-hole 28 by suction airflow 71. However, when dust 52*c* collides with the wall surface or bottom part of first etched hole 104 (recess of the upstream hole), or is caught by communicating part 106 and stops, the part other than the head part of thread-like dust 52*c* is carried toward the front from through-hole 28.

Then, the head part of thread-like dust 52*c* that is carried toward the front is drawn to the downstream side by suction airflow 71, most of the other part is pulled to the upstream side by whirling air current 50. However, since the wind power of whirling air current 50 is stronger than that of suction airflow 71, thread-like dust 52*c* is pulled out to upstream filter surface 61 side outside of through-hole 28. Then, thread-like dust 52*c* pulled out to upstream filter surface 61 further continues to whirl by whirling air current 50, gradually descends by gravity, and is accommodated in dust accommodating section 24 disposed below.

As described above, even if thread-like dust 52*c* is about to clog the inclined through-hole 28, thread-like dust 52*c* is returned to the upstream side of first filtration filter 27*a* by the action of whirling air current 50. Therefore, clogging of first filtration filter 27*a* by thread-like dust 52*c* is prevented, so that air permeability of first filtration filter 27*a* can be maintained. Then, reduction in air volume of the vacuum cleaner is not reduced, and a strong suction force can be maintained for a long time. Moreover, it is possible to provide a vacuum cleaner capable of easily discharging dust after cleaning work because thread-like dust 52*c* is not tangled in first filtration filter 27*a*.

Fourth Exemplary Embodiment

Figure 13:
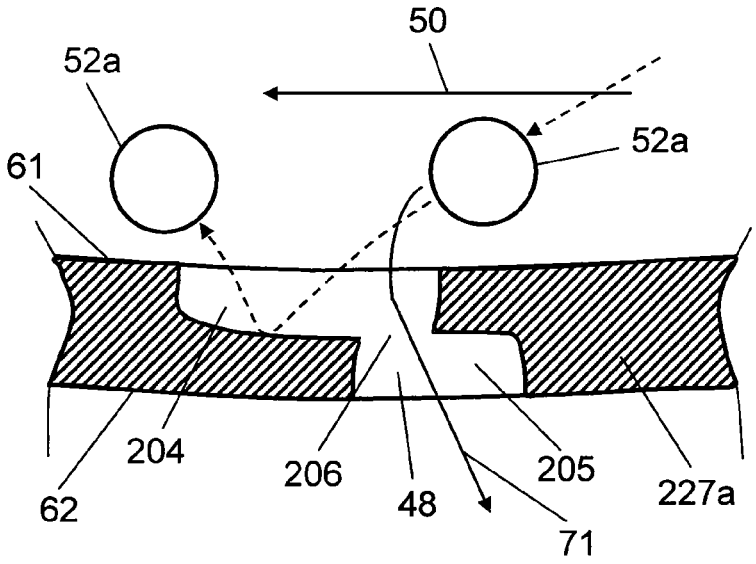
FIG. 13 is a view to illustrate a separation operation for separating grain dust in a vacuum cleaner in accordance with a fourth exemplary embodiment of the present invention.

Next, a modified example of the first filtration filter of the vacuum cleaner of the third exemplary embodiment of the present invention is described. FIG. 13 is a view to illustrate a separation operation for separating grain dust in the vacuum cleaner in accordance with a fourth exemplary embodiment of the present invention. FIG. 13 is an enlarged view showing a principal part of one of through holes 48 of first filtration filter 227*a* placed in dust separator 23, illustrating a separation operation for separating dust having heavier specific gravity.

Note here that the same reference numerals are given to the same configurations as those in the first to third exemplary embodiments of the present invention, and the description thereof is omitted.

In first filtration filter 227*a*, the hole diameter of first etched hole (upstream hole) 204 is made to be larger than that of second etched hole (downstream hole) 205. When sucked dust is grain dust 52*a* such as sand grain having heavier specific gravity as compared with other dust, grain dust 52*a* whirls by whirling air current 50 in space at upstream filter surface 61 side. Most of the whirling grain dust 52*a* is subjected to a centrifugal force, and moves to the outer side from the direction in which whirling air current 50 flows and is thrown to upstream filter surface 61.

Then, grain dust 52*a* that approaches through-hole 48 of upstream filter surface 61 and attempts to enter through-hole 28 slightly changes its orbit by the influence of suction airflow 71 and then is drawn to communicating part 206 side. At the time, as shown in FIG. 11A, when the hole diameter of first etched hole 104 approximates to the diameter of grain dust 52*a*, grain dust 52*a* is stuck in first etched hole 104. As a result, clogging of first filtration filter 27*a* may occur.

However, as shown in FIG. 13, when the hole diameter of first etched hole 204 (concave part of the upstream hole) of through-hole 48 is made to be larger than the hole diameter of second etched hole 205, grain dust 52*a* is drawn to communication part 206 by the influence of suction airflow 71. However, grain dust 52*a* obliquely collides with the bottom part of first etched hole 204 by whirling air current 50, and is thrown out to the outside of through-hole 48. Thus, grain dust 52*a* is inhibited from entering and being stuck in a deep part of through-hole 48. Then, grain dust 52*a* is carried toward the front from through-hole 48 by whirling air current 50, further continues to whirl by whirling air current 50, gradually descends by gravity, and is accommodated in dust accommodating section 24 located below.

Fifth Exemplary Embodiment

Next, a different example of the first filtration filter and a manufacturing method thereof are described with reference to FIG. 14. FIGS. 14A to 14C are sectional process views to illustrate a method of manufacturing a first filtration filter of a vacuum cleaner in accordance with a fifth exemplary embodiment of the present invention.

Since the configuration of the vacuum cleaner in accordance with the fifth exemplary embodiment of the present invention is the same as that of the first to fourth exemplary embodiments except for the first filtration filter, the same reference numerals are given to the same configurations, and the description thereof is omitted.

Figure 14A:
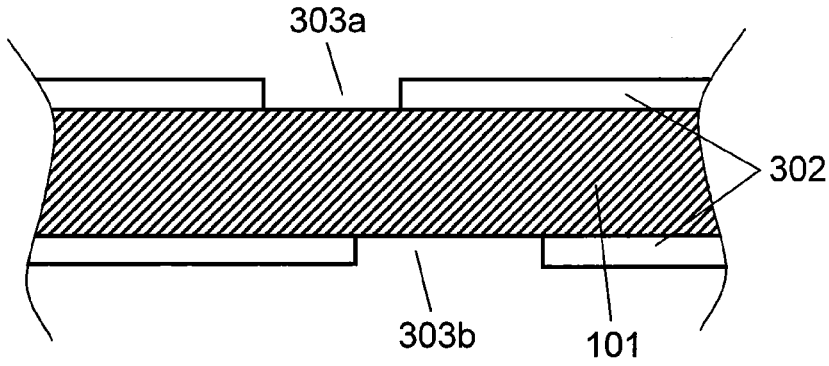
FIG. 14A is a sectional process view to illustrate a method of manufacturing a first filtration filter of a vacuum cleaner in accordance with a fifth exemplary embodiment of the present invention.
Figure 14B:
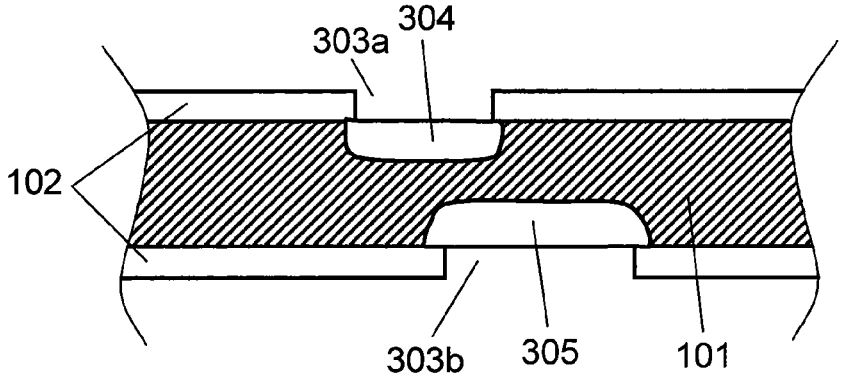
FIG. 14B is a sectional process view to illustrate the method of manufacturing the first filtration filter of the vacuum cleaner.
Figure 14C:
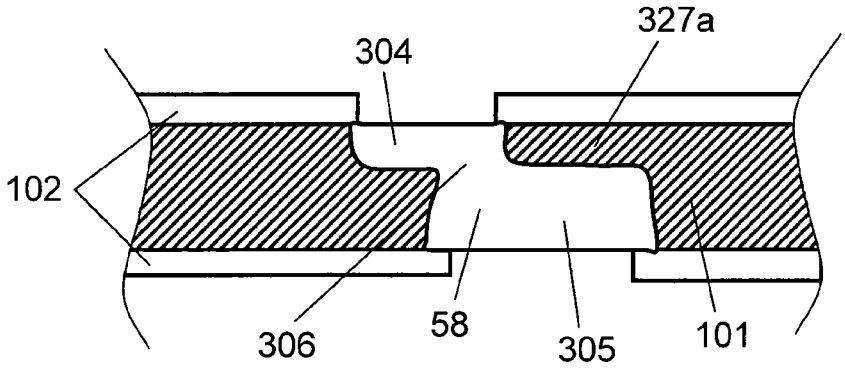
FIG. 14C is a sectional process view to illustrate a method of manufacturing the first filtration filter of the vacuum cleaner.

FIGS. 14A to 14C are views showing the process order for etching the first filtration filter. In FIG. 14A, resist 302 is coated on the front and rear surfaces of metal plate 101 having a thickness of 0.1 mm to 0.3 mm. Then, by an exposure process, resist patterns are formed on the front and rear surfaces. The resist patterns have openings 303*a* and 303*b* whose positions in the plane direction are shifted from each other. At this time, opening 303*b* of the resist pattern on the rear surface is made to be 1-2 times larger than opening 303*a* on the front surface.

Next, as shown in FIG. 14B, etching is carried out with an etchant from both the front surface and the rear surface of metal plate 101. First etched hole 304 etched from the front surface is etched shallowly and second etched hole 305 having larger hole diameter and being etched from the rear surface is etched deeply. This phenomenon occurs because openings 303*a* and 303*b* of the etching pattern are small. The etching pattern whose opening is larger is etched faster, so that the depth of second etched hole 305 becomes deeper. This phenomenon occurs not only in the vertical direction but also in the horizontal direction. The etched hole extends in the horizontal direction from openings 303*a* and 303*b* of the resist patterns.

When etching is further carried out, as shown in FIG. 14C, first etched hole (upstream hole) 304 and second etched hole (downstream hole) 305 are communicated with each other so as to form communicating part 306. Through-hole 58 linking the front surface with the rear surface is formed in metal plate 101. Thereafter, the resist patterns are etched removed, and thus the process for forming through-hole 58 is completed.

The thus completed plate-like filtration filter is incorporated in dust separator 23 in a state in which it is rounded in a cylindrical shape when the filtration filter is incorporated into dust collecting case 5 in the next assembling process of dust collecting case 5. Then, the filter is used as cylindrical filtration filter 327*a*.

First filtration filter 327*a* formed in such an etching process has a shape in which second etched hole (downstream hole) 305 at the rear surface side is largely opened in the direction from communicating part 306 of through-hole 58 to the downstream side. Therefore, dust that has passed through communicating part 306 can be allowed to pass through to the downstream side without resistance. Therefore, dust can be well removed, and thus, clogging of dust does not tend to occur. When first filtration filter 327*a* is cleaned after cleaning work, thread-like dust such as hair can further be inhibited from being tangled and clogging in first filtration filter 327*a*. As a result, vacuum cleaner that is excellent in a cleaning maintenance property of first filtration filter 327*a* can be provided.

Sixth Exemplary Embodiment

Next, another different example of the first filtration filter and a method of manufacturing the same are described with reference to FIG. 15. FIGS. 15A and 15B are sectional process views to illustrate a method of manufacturing a first filtration filter of a vacuum cleaner in accordance with a sixth exemplary embodiment of the present invention.

Since the configuration of the vacuum cleaner in accordance with the sixth exemplary embodiment of the present invention is the same as that of the vacuum cleaner of the first to fifth exemplary embodiments except for the first filtration filter, the same reference numerals are given to the same configurations, and the description thereof is omitted.

Figure 15A:
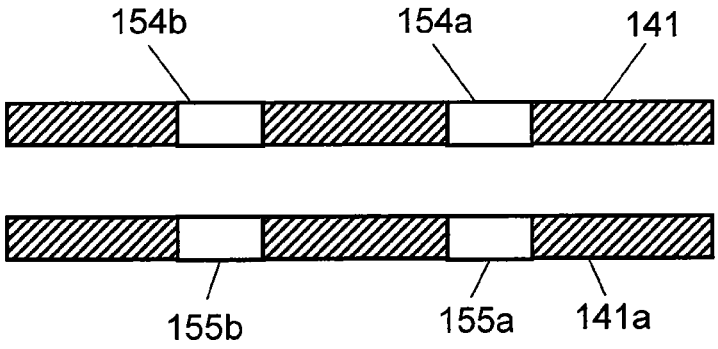
FIG. 15A is a sectional process view to illustrate a method of manufacturing a first filtration filter of a vacuum cleaner in accordance with a sixth exemplary embodiment of the present invention.
Figure 15B:
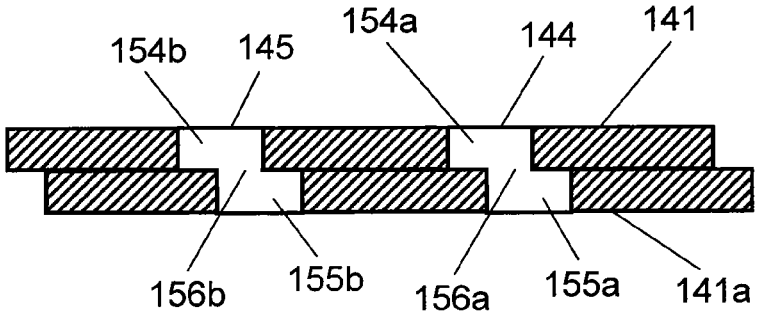
FIG. 15B is a sectional process view to illustrate a method of manufacturing the first filtration filter of the vacuum cleaner.

FIGS. 15A and 15B are views showing a process order for assembling one filtration filter by using two filtration filters. A case in which 0.3 mm-thick filtration filters are assembled is described.

In FIG. 15A, two filtration filters, filtration filters 141 and 141*a* are prepared in advance. Filtration filters 141 and 141*a* are obtained by forming a plurality of through-holes in 0.15 mm-thick metal plates by etching or punching.

Filtration filter 141 is located at the upstream side in the filtration filter formed by combining two filters mentioned below, and has a plurality of through-holes 154*a* and 154*b* as the upstream holes. Furthermore, filtration filter 141*a* is located at the downstream side in the filtration filter formed by combining two filters mentioned below, and has a plurality of through-holes 155*a* and 155*b* as the downstream holes.

Next, in FIG. 15B, two filtration filters 141 and 141*a* are piled up to each other in a state in which the positions of filtration filters 141 and 141*a* are shifted from each other such that a part of upstream hole 154*a* and a part of downstream hole 155*a* are overlapped with each other and a part of upstream hole 154*b* and a part of downstream hole 155*b* are overlapped with each other. Thus, one filtration filter is completed. Then, upstream hole 154*a* and downstream hole 155*a* are communicated with each other via communicating part 156*a* so as to form through-hole 144. Upstream hole 154*b* and downstream hole 155*b* are communicated with each other via communicating part 156*b* so as to form through-hole 145.

Thus, the length in the plane from the center point of upstream hole 154*a* to the center point of downstream hole 155*a* can be made to be the same as that from the center point of upstream hole 154*b* to the center point of downstream hole 155*b*. By shifting the positions of a plurality of through-holes located in a plurality of positions by the same length, a filtration filter having a plurality of through-holes 144 and 145 whose central axes are inclined can be easily assembled.

Thus, in a filtration filter produced by piling up two filtration filters so as to have a predetermined thickness, since the etching depth per filter can be about ½ as compared with the depth in the case in which etching processing is carried out by using one metal plate having a predetermined thickness, and thereby error by horizontal expansion of etching becomes about ½. Thus, a plurality of through-holes having uniform shapes can be finished.

In the sixth exemplary embodiment of the present invention, an example in which a filtration filter is manufactured by using two metal plates is described. However, one filtration filter may be formed by using three 0.1 mm-thick metal plates. In this way, as compared with the case in which two metal plates are piled up together as mentioned above, finish error in etching can be further reduced. As a result, a filtration filter having a plurality of more smoothly inclined through-holes can be completed. Furthermore, when the number of metal plates to be piled up is further increased, an angle of the through-hole can be inclined more largely in accordance with the number of metal plates to be piled up.

The above-mentioned first to sixth exemplary embodiments of the present invention describe an example using a cylindrical filtration filter having a large number of through-holes on the entire surface of the filter surface. However, a filtration filter may have through-holes partially on the surface thereof.

Furthermore, the configurations of the above-mentioned first to sixth exemplary embodiments of the present invention are not necessarily limited to this configuration. Exemplary embodiments may be appropriately combined if necessary.

INDUSTRIAL APPLICABILITY

As mentioned above, a vacuum cleaner of the present invention secures high suction power by preventing thread-like dust from being tangled in a filtration filter. Furthermore, the burden of maintenance operations such as cleaning of a filtration filter and discharging of dust can be largely reduced. The filtration filter can be used in various kinds of vacuum cleaners including not only vacuum cleaners for domestic use but also vacuum cleaners for business use.

The invention claimed is:

1. A vacuum cleaner comprising;

a dust separator upstream of the electric air blower, the dust separator configured to receive dust-containing air sucked by the electric air blower and generate a whirling air current, the dust separator including a substantially cylindrical filtration filter configured to separate dust from the dust-containing air; and a dust accommodating section arranged under the dust separator and configured to accommodate dust separated by the dust separator, wherein the filtration filter is formed by shaping a flat plate into a substantially cylindrical shape, the flat plate having a plurality of through-holes penetrating between a front surface and a rear surface, each through-hole having a central axis forming a vector that is inclined with respect to a normal line of the front surface, such that the vector has an X-component and a Y-component perpendicular to said X-component and wherein the X-component is substantially opposite a direction of the whirling air current flowing along an upstream surface of the substantially cylindrical filtration filter.

2. The vacuum cleaner of claim 1, wherein the through-holes have a first diameter and a second diameter, wherein the second diameter is downstream the first diameter and the second diameter is greater than the first diameter.

3. The vacuum cleaner of claim 1, wherein the through-holes include an upstream hole, a downstream hole, and a communicating hole for communicating the upstream hole with the downstream hole, and a diameter of the communicating hole is less than diameters of the upstream hole and the downstream hole.

4. The vacuum cleaner of claim 1, wherein the flat plate is a metal plate and the through-holes are formed by an etching process to the metal plate, such that a first etched hole is formed in the front surface of the filtration filter, a second etched hole is formed in the rear surface of the filtration filter, and the first etched hole and the second etched hole are combined with each other.

5. The vacuum cleaner of claim 4, wherein a bottom surface formed in a recess of the first etched hole, the bottom surface configured such that sucked dust collides with the bottom surface to suppress dust from being stuck in the substantially cylindrical filtration filter.

6. The vacuum cleaner of claim 5, wherein the through-holes have a communicating portion between the first etched hole and the second etched hole, and the through-holes are further formed by removing an edge on a boundary between the first etched hole and the second etched hole to smoothen the communicating portion and form an inclined surface.

7. The vacuum cleaner of claim 4, wherein the through-holes have a communicating portion between the first etched hole and the second etched hole, and the through-holes are further formed by removing an edge on a boundary between the first etched hole and the second etched hole to smoothen the communicating portion and form an inclined surface.

* * * * *